US008104393B2

(12) United States Patent
Kincel

(10) Patent No.: US 8,104,393 B2
(45) Date of Patent: Jan. 31, 2012

(54) CHARGING HANDLE

(75) Inventor: Eric Kincel, Tucson, AZ (US)

(73) Assignee: Abrams Airborne Inc., Tucson, AZ (US)

( * ) Notice: Subject to any disclaimer, the term of this patent is extended or adjusted under 35 U.S.C. 154(b) by 377 days.

(21) Appl. No.: 12/460,001

(22) Filed: Jul. 10, 2009

(65) Prior Publication Data

US 2011/0005372 A1 Jan. 13, 2011

(51) Int. Cl.
*F41A 7/02* (2006.01)

(52) U.S. Cl. ..... 89/1.14; 42/16; 89/191.01

(58) Field of Classification Search ..... 89/1.4; 42/16

See application file for complete search history.

(56) References Cited

U.S. PATENT DOCUMENTS 3,225,653 A * 12/1965 Packard ..... 89/1.4
6,311,603 B1 * 11/2001 Dunlap ..... 89/1.4
7,231,861 B1 * 6/2007 Gauny et al. ..... 89/1.4
7,240,600 B1 * 7/2007 Bordson ..... 89/1.4
7,444,775 B1 * 11/2008 Schuetz ..... 42/76.01
D614,718 S * 4/2010 Hoel ..... D22/108
7,707,921 B1 * 5/2010 Hoel ..... 89/1.4
7,832,322 B1 * 11/2010 Hoel ..... 89/1.4
7,861,635 B1 * 1/2011 Hoel ..... 89/1.4
7,900,546 B2 * 3/2011 Bordson ..... 89/1.4
2006/0026883 A1 * 2/2006 Hochstrate et al. ..... 42/75.01
2010/0162604 A1 * 7/2010 Dubois ..... 42/18

* cited by examiner

*Primary Examiner* — Bret Hayes
*Assistant Examiner* — Joshua Freeman
(74) *Attorney, Agent, or Firm* — Mark Ogram

(57) ABSTRACT

The invention relates to a charging handle assembly for a firearm. The assembly includes a handle mechanism having a pull rod to engage an action of a firearm, a handle and a stop surface. A latch mechanism is rotationally secured to the handle and is meant to be manually activated. When the latch mechanism is moved to an open position, a surface of the latch mechanism contacts the stop surface of the handle mechanism. A spring mechanism is used to maintain the latch mechanism in a closed position.

15 Claims, 5 Drawing Sheets

35
34
NOSE
M
32

CHARGING HANDLE

BACKGROUND OF THE INVENTION

This invention relates generally to firearms and more particularly to a charging handle associated therewith.

For many modern firearms, a charging handle is used to engage the bolt assembly of the firearm so that a preliminary cartridge is loaded into the action. This charging handle is typically mounted parallel with the bolt assembly and is manually operated to pull the bolt assembly to insert the first cartridge. Once the first cartridge is loaded, the charging handle is latched to the firearm as the firing of the first cartridge produces gas pressure to load the second and subsequent cartridges.

The charging handle utilizes a handle portion which was originally designed to be grasped by the operator using two fingers, one placed on each side of the pull rod. In the pulling action, the latch is pulled back into a slot in the handle portion, thereby releasing the charging handle so that it can be withdrawn to load the cartridge.

While this technique works well, it does require the use of two fingers and that the weapon be moved off target for the initial charging. To eliminate these problems, paddles or strike pads were added by extending them from the latch. In operation, the user, using one finger or the back of the hand, presses the paddle backwards while the weapon remains on target. This movement against the paddle releases the latch and pulls the charging handle backwards to load the weapon.

Unfortunately, this arrangement forces the latch to rotate abnormally with all of the force on the latch mechanism, thereby placing a great deal of stress on the pin used to secure the latch to the handle portion. This stress manifests itself in rapid metal fatigue of the pin and a twisting motion in the latch.

It is clear there is a need for an improved charging handle.

SUMMARY OF THE INVENTION

The invention relates to a charging handle assembly for a firearm. Those of ordinary skill in the art readily recognize the use of a charging handle. Examples of such apparatus are described in: U.S. Pat. No. 5,351,598, entitled "Gas-Operated Rifle System" issued to Schuetz on Oct. 4, 1994; U.S. Pat. No. 5,448,940, entitled "Gas-Operated M16 Pistol" issued to Schuetz et al. on Sep. 12, 1995; U.S. Pat. No. 5,551,179, entitled "Bolt Carrier" issued to Young on Sep. 3, 1996; U.S. Pat. No. 5,499,569, entitled "Gas-Operated Rifle System" issued to Schuetz on Mar. 19, 1996; and, U.S. Pat. No. 7,461, 581, entitled "Self-Cleaning Gas Operating System for a Firearm" issued to Leitner-Wise on Dec. 9, 2008, all of which are incorporated hereinto by reference.

The invention is an assembly which includes a handle mechanism having a pull rod to engage an action of a firearm. At one end of the assembly is a handle allowing the operator to manually operate the charging mechanism. On the handle portion of the charging handle is a stop surface.

A latch mechanism is rotationally secured to the handle and is meant to be manually activated to disengage the mechanism from the firearm, thereby allowing the charging handle to be pulled to load the weapon with a cartridge. The latch mechanism is secured to the handle via a pin.

When the latch mechanism is moved to an open position, a surface of the latch mechanism contacts the stop surface of the handle mechanism. In this manner, pressure from the user's operation of the charging handle is transferred from the pin to the contact between the latch mechanism and the stop surface.

In the preferred embodiment of the invention, a second stop surface is also used on the handle portion. This second stop surface engages a secondary portion of the latch substantially simultaneously with the contact between the initial stop surface and the latch mechanism.

This preferred embodiment significantly strengthens the charging handle so that metal fatigue and torque is all but eliminated.

A spring mechanism is used to maintain the latch mechanism in a closed position. The spring is held within a cavity of the handle and presses against a surface of the latch mechanism.

The invention, together with various embodiments thereof will be more fully explained by the accompanying drawings and the following description thereof.

DRAWINGS IN BRIEF

FIGS. 3A and 3B are top and perspective views of the preferred embodiment of the latch mechanism.

DRAWINGS IN DETAIL

Figure 1A:
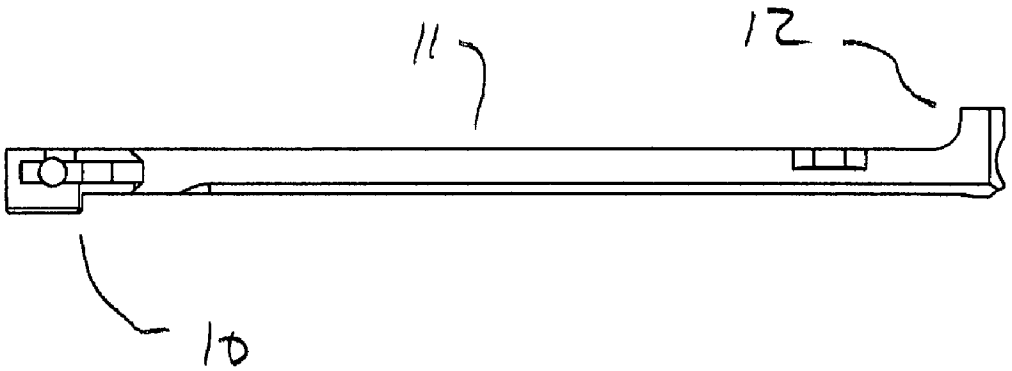
FIGS. 1A and 1B are side and bottom views of the preferred handle mechanism.
Figure 1B:
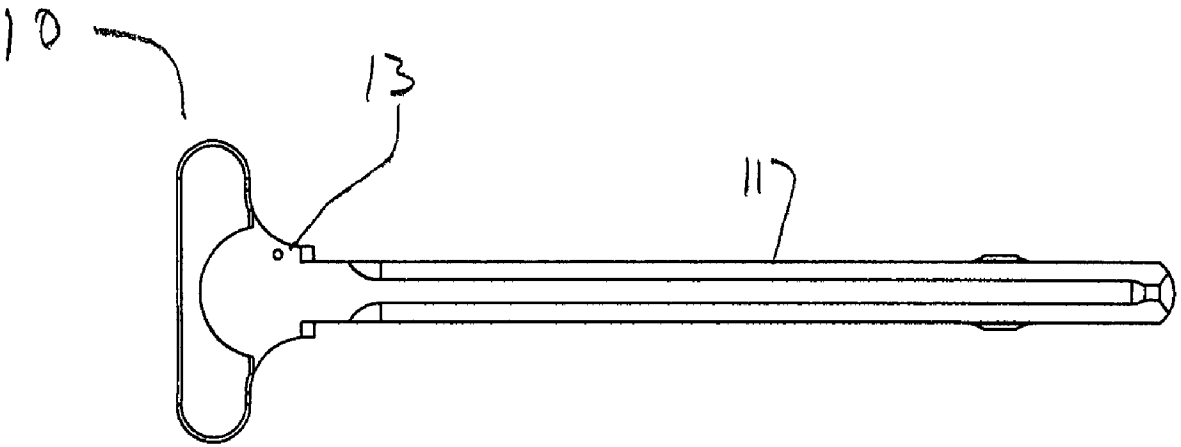

FIGS. 1A and 1B are side and bottom views of the preferred handle mechanism.

The handle mechanism has a handle portion 10 which is designed to be gripped using two fingers in the traditional embodiment. A rod 11 extends to the hook mechanism 12 which is designed to engage the action of the firearm.

As the handle is withdrawn, the hook mechanism engages the bolt mechanism of the firearm and loads a cartridge into the chamber of the firearm.

Hole 13 is used to affix the latch mechanism to the handle mechanism.

Figure 2A:
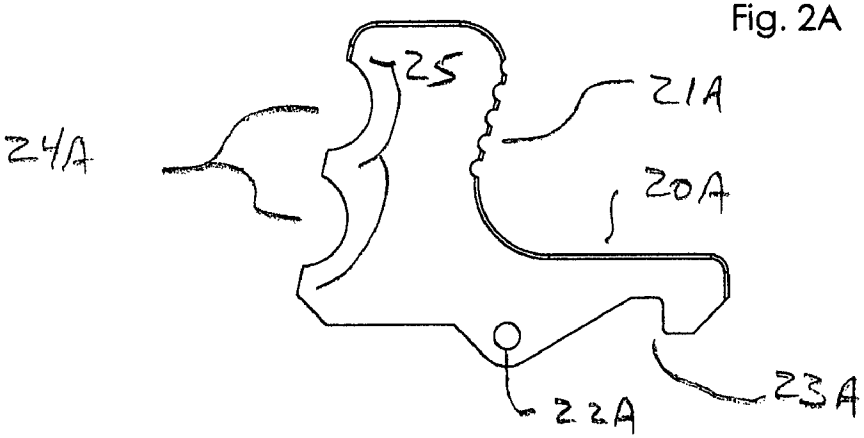
FIGS. 2A and 2B illustrate two different embodiments of the latch mechanism.
Figure 2B:
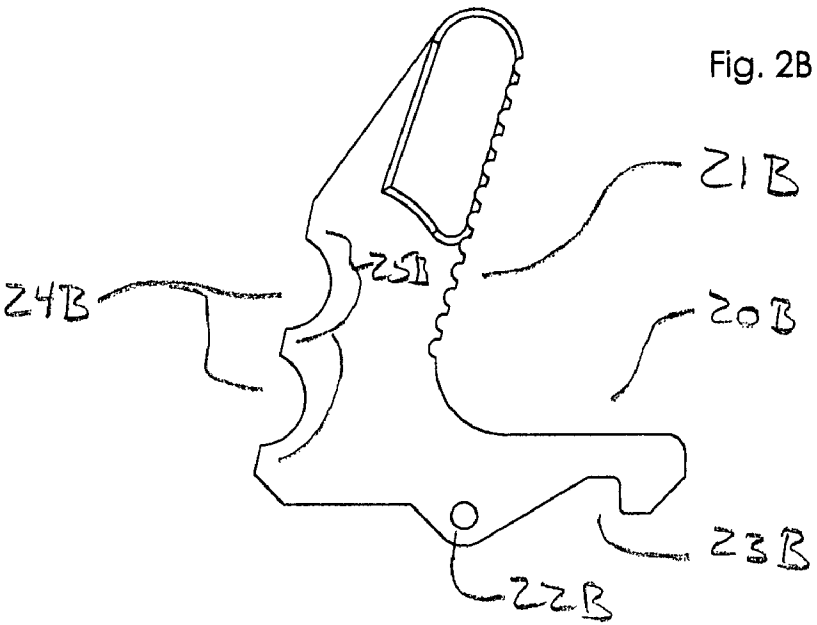
Figure 9:
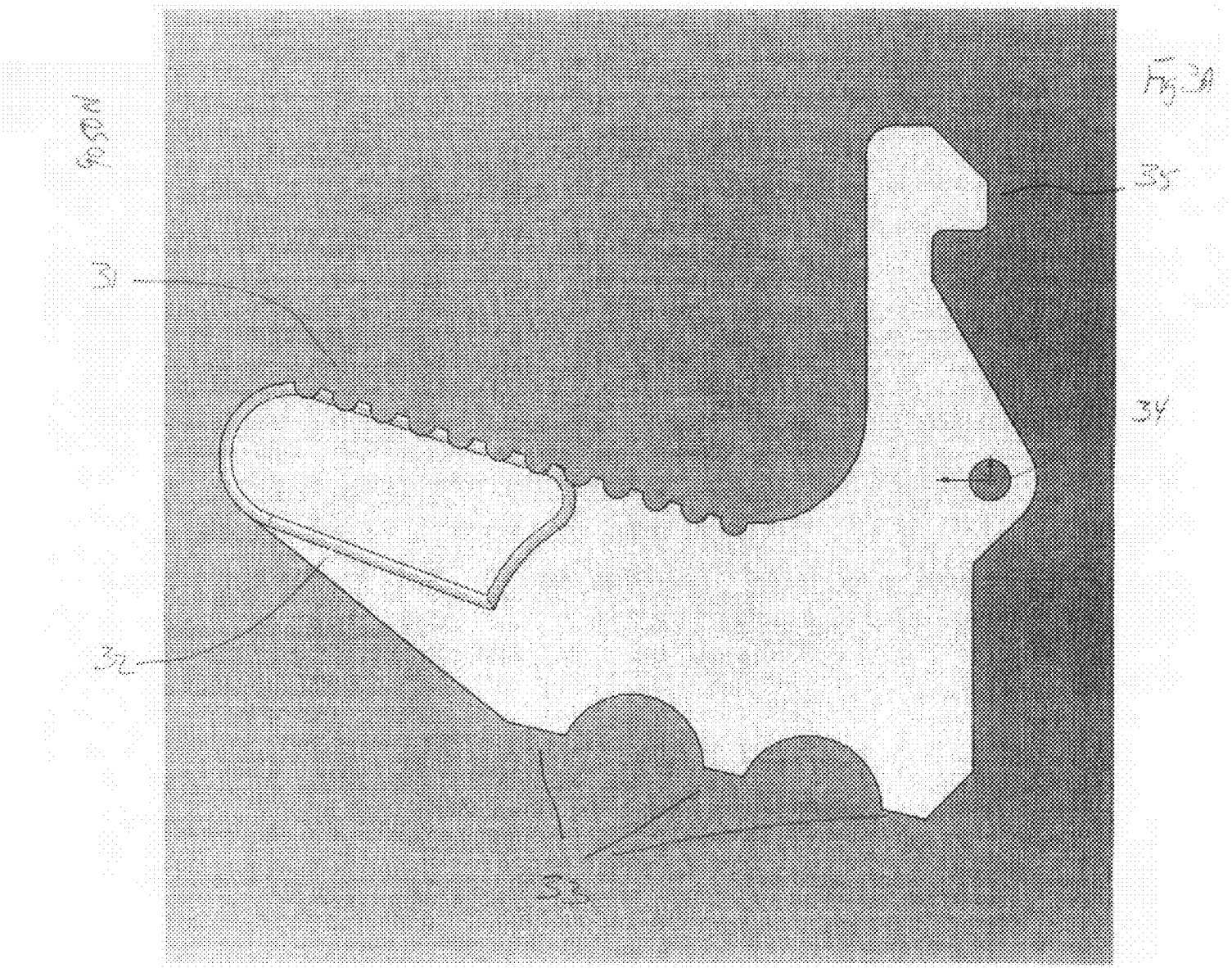

FIGS. 2A and 2B illustrate two different embodiments of the latch mechanism.

These two embodiments are very similar in general construction. Paddles 21A and 21B permit operator pressure to engage the charging handle to that rotation occurs around a pin positioned through hole 22A and 22B. A pin, not shown, secures the latch mechanisms to the hole 13 and handle mechanism described in FIGS. 1A and 1B. This rotation causes hook 23A and 23B to disengage from the firearm, thereby permitting the handle mechanism to be withdrawn to load the weapon.

The embodiments of FIGS. 2A and 2B have reservoirs 24A and 24B which permit debris, such as dirt and water, to collect therein, thereby discouraging the jamming of the mechanism when fouled.

The difference between the embodiment of FIG. 2A and FIG. 2B lies in the length of the paddle 21A and 21B. These different embodiments allow the user of the firearm to select the length of the paddle that best fits their needs.

Note the surfaces 25A and 25B of the two embodiments. These surfaces are designed to engage a stop surface on the handle mechanism during the operator's movement of paddles 21A and 21B, thereby checking the movement so that undue torque is not imparted into the pin within holes 22A and 22B.

Figure 3B:
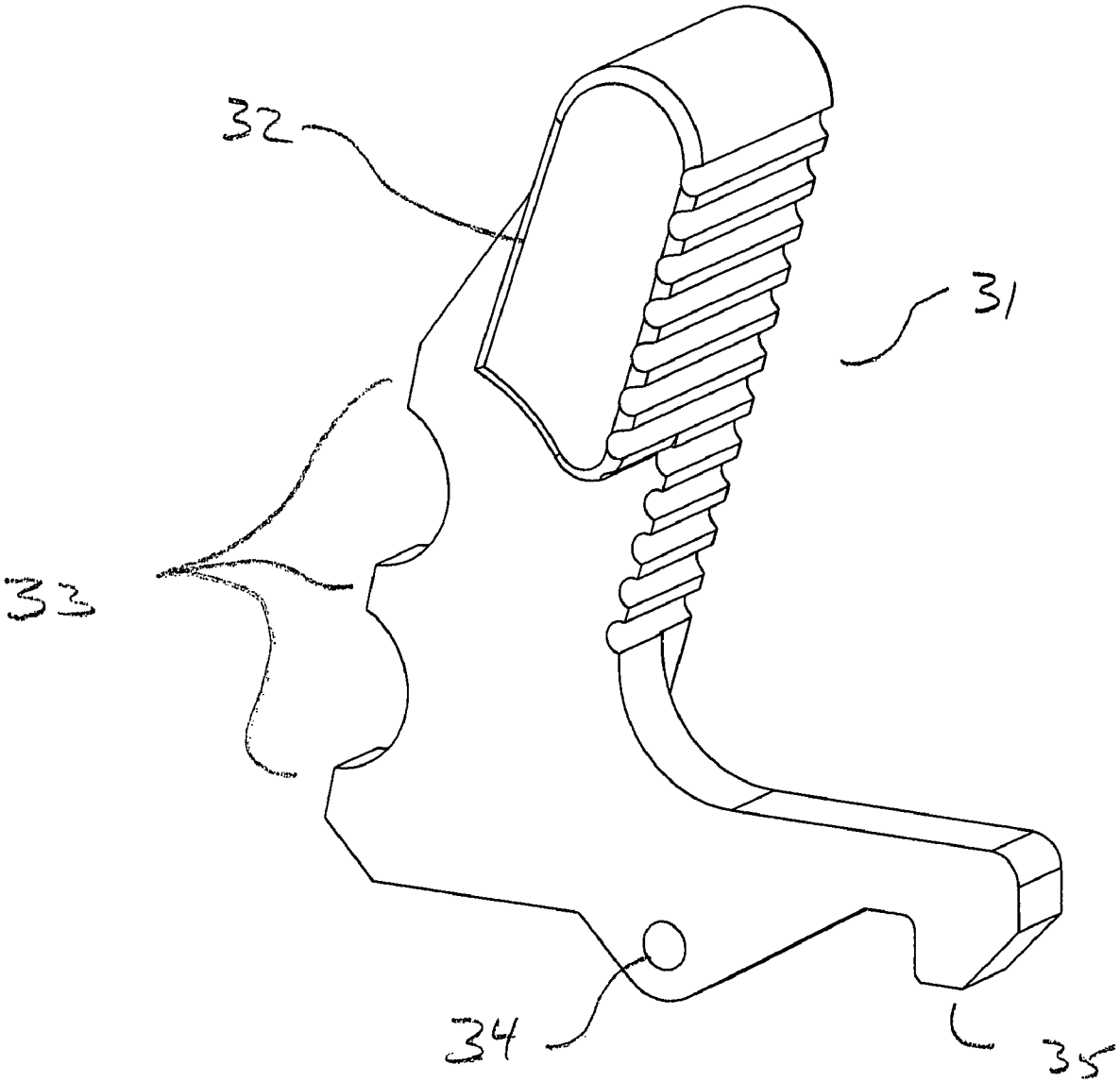

FIGS. 3A and 3B are top and perspective views of the preferred embodiment of the latch mechanism.

As with the embodiments described in FIGS. 2A and 2B, the embodiment of the latch mechanism shown in FIGS. 3A and 3B is also designed to be secured to the handle mechanism via a pin through hole 34 and the latch mechanism is operated by operator pressure upon paddle 31, which causes hook 35 to disengage.

In this embodiment, surfaces 33 are used to check the rotational movement of the latch mechanism, and a second surface 32 is also used to engage a stop surface on the handle portion of the handle mechanism. Surface 33 and surface 32 are configured to engage their respective stop surfaces at the same time, to provide even more durability for the assembly since torque caused during operator operation of paddle 31 is spread to the surfaces 33 and surface 32.

Figure 4A:
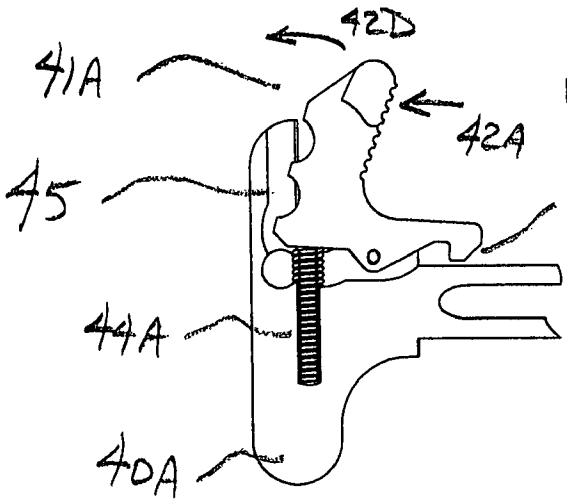
FIGS. 4A and 4B illustrate the charging handle assembly in operation.
Figure 4B:
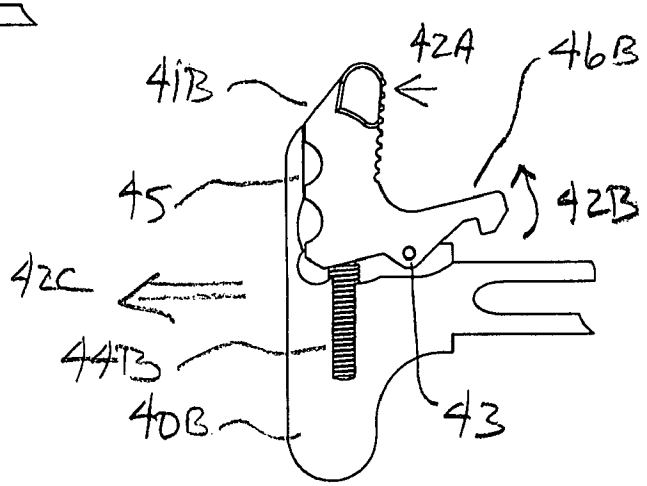

FIGS. 4A and 4B illustrate the charging handle assembly in operation.

FIG. 4A shows the charging handle assembly in a latched position. Hook 46A is positioned to engage the firearm and prevent the charging handle from moving. Latch mechanism 41A is maintained in this position via spring 44A. To disengage hook 46A, the operator provides pressure, as illustrated by arrow 42A which causes the latch mechanism 41A to rotate around pin 43 and move as indicated by arrow 42D.

This rotation around pin 43 results in the arrangement illustrated in FIG. 4B. Latch mechanism 41B has rotated because of the pressure 42A so that the rear surface of latch mechanism 41B engages stop 45 contained within handle 40B. Additionally, hook 46B has now moved as indicated by arrow 42B; and, pressure 42A causes the entire assembly to move as indicated by arrow 42C.

When the operator releases pressure 42A, spring 44B, now in a compressed state, cause the latch mechanism to rotate forward so that hook 46B is again positioned to engage the firearm.

In this manner, minimal torque is applied to pin 43 as the rear surface of latch mechanism 41B and stop surface 45 bear the majority of the pressure caused by the operator during operation of the charging handle.

Figure 5:
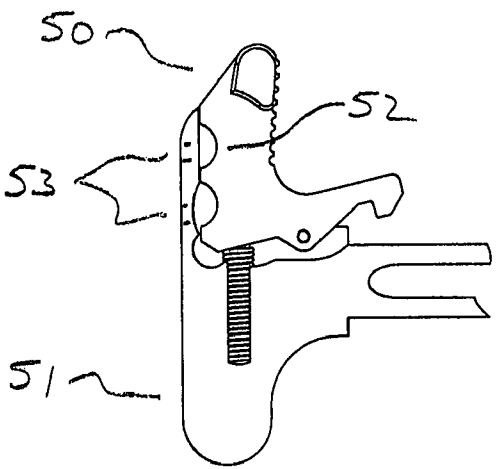
FIG. 5 illustrates the embodiment of the invention having purging openings.

FIG. 5 illustrates the embodiment of the invention having purging openings.

In this embodiment of the invention, latch mechanism 50 has reservoirs 52 positioned along it rear surface as first described relative to FIGS. 3A and 3B. When latch mechanism 50 is moved to the rear, thereby operating charging the charging handle, the rear surface of latch mechanism 50 engages a stop surface of handle 51, and reservoirs 52 are aligned with purging openings 53. Purging openings 53 permit dirt and water to escaped from handle 51 to the movement of latch mechanism 50 is not impaired.

In another embodiment, the purging openings are below the reservoirs, allowing gravity to expunge the debris collected in the reservoirs.

The present invention provides for a highly improved charging handle

What is claimed is:

1. A charging handle assembly for a firearm comprising:

a) a handle mechanism having, 1) a pull rod configured to engage an action of a firearm, and, 2) a handle portion configured to be manually operated;

b) a latch mechanism being rotationally secured to the handle portion and having a rearward facing secondary surface; and, c) a spring mechanism positioned to maintain said latch mechanism in a closed position; and, wherein when said latch mechanism is manually moved to an open position, the rearward facing secondary surface of said latch mechanism engages a surface area of said handle mechanism.

2. The charging handle according to claim 1 ,wherein said latch mechanism includes a paddle extending therefrom, said paddle configured to be manually operable to move said latch mechanism to an open position.

3. The charging handle according to claim 2, wherein said rear surface area of said latch mechanism is irregularly shaped.

4. The charging handle according to claim 2, wherein the rear surface area of said latch mechanism includes at least one reservoir adapted to accept debris.

5. The charging handle according to claim 4, further including at least one opening in the surface area of said handle mechanism, each of said at least one opening aligned with one of said reservoirs in said latch mechanism when said latch mechanism is in an open position.

6. A charging handle assembly for a firearm comprising:

a) a handle mechanism having, 1) a pull rod having an engaging point configured to engage an action of a firearm, 2) a handle portion configured to be manually operated, and, 3) a stop surface along a rearward surface of said handle mechanism;

b) a latch mechanism having a paddle configured to accept pressure from an operator and a hook latch configured to engage the firearm when said latch mechanism is in a closed position;

c) a pin rotationally securing the latch mechanism to the handle portion such that when said paddle is engaged by an operator, said latch mechanism rotates into an open position, and wherein when latch mechanism is manually moved to an open position, a rear surface area of said latch mechanism engages the stop surface of said handle mechanism; and, d) a spring mechanism positioned to maintain said latch mechanism in a closed position.

7. The charging handle according to claim 6, a) wherein said latch mechanism further includes a rearward facing secondary surface; and, b) wherein said handle includes a second stop surface positioned to engage said rearward facing secondary surface when said handle is in the open position.

8. The charging handle according to claim 7, wherein, when the latch mechanism is moved to the open position, the rear surface of said latch mechanism engages the stop surface of the handle portion and the secondary surface of the latch mechanism engages the second stop surface simultaneously.

9. The charging handle according to claim 8, wherein said rear surface area of said latch mechanism is irregularly shaped.

10. The charging handle according to claim 8, wherein the rear surface area of said latch mechanism includes at least one reservoir adapted to accept debris.

11. The charging handle according to claim 10, further including at least one opening in the surface area of said handle mechanism, each of said at least one opening aligned with one of said reservoirs in said latch mechanism when said latch mechanism is in an open position.

12. A charging handle assembly for a firearm comprising:

a) a pull rod configured to engage an action of a firearm at a first end thereof an a handle portion on a second end thereof; and, b) a latch mechanism being rotationally secured to the handle portion having a back plate, wherein when latch mechanism is manually moved to an open position, a rear surface area of said latch mechanism engages a surface area of said handle mechanism, and wherein said latch mechanism includes a rearward facing secondary surface and wherein the rearward facing secondary surface engages a back plate of said handle portion.

13. The charging handle according to claim 12, wherein said latch mechanism includes a paddle extending therefrom, said paddle configured to be manually operable to move said latch mechanism to an open position.

14. The charging handle according to claim 12, wherein the rear surface area of said latch mechanism includes at least one reservoir adapted to accept debris to prevent fouling of movement of said latch mechanism in moving from a closed position to an open position.

15. The charging handle according to claim 14, further including at least one opening in the surface area of said handle mechanism, each of said at least one opening aligned with one of said reservoirs in said latch mechanism when said latch mechanism is in an open position.

* * * * *